US005188307A

United States Patent [19]

Miller

[11] Patent Number: 5,188,307

[45] Date of Patent: Feb. 23, 1993

[54] TOOL FOR COILING FIRE HOSES AND A METHOD OF USE THEREFOR

[75] Inventor: Brian D. Miller, Kitchener, Canada

[73] Assignee: Cobra Fire Corporation, Guelph, Canada

[21] Appl. No.: 650,288

[22] Filed: Feb. 4, 1991

[51] Int. Cl.[5] ..... B65M 75/40

[52] U.S. Cl. ..... 242/86; 242/96

[58] Field of Search ..... 242/86, 86.1, 96, 85, 242/115, 77, 100, 100.1, 106; 137/355.27, 355.26

[56] References Cited

U.S. PATENT DOCUMENTS

| | | | |
|---|---|---|---|
| 472,593 | 4/1892 | Tache | 242/96 |
| 1,871,483 | 8/1932 | Uitendaal | 242/96 |
| 2,197,767 | 4/1940 | Neale | 242/86 |
| 2,933,262 | 4/1960 | Fish | 242/86.1 |
| 3,946,964 | 3/1976 | Zinser | 242/86 |
| 4,101,088 | 7/1978 | Stauth | 242/85 |
| 5,033,690 | 7/1991 | McIver | 242/86 |

*Primary Examiner*—John M. Jillions
*Attorney, Agent, or Firm*—Daryl W. Schnurr

[57] ABSTRACT

A tool for coiling a fire hose lying on a supporting surface has an elongated member with a pivot point at a lower termination thereof and a handle at an upper termination thereof. The elongated member has at least two telescoping sections with releasable locking means so that the tool can be placed in a collapsed position for storage. In a method of using the tool when it is in an extended position, a user can carry the tool to a fire hose to be coiled. The tool is placed over the fire hose so that an L-shaped retention means on the tool retains the fire hose as it is being coiled. The fire hose can be retained near one end thereof or near a center depending on the type of coil desired. When the fire hose is suitably retained, the elongated member is rotated about the pivot point by manually rotating the handle. When the coiling has been completed, the tool is raised to release the hose from the retention means. The fire hose can be coiled wihtout any direct contact between the user of the tool and the hose. Water in the hose automatically drains from the hose during coiling. Previous devices have not been sufficiently efficient to replace the current popular method of rolling the fire hoses by hand.

12 Claims, 3 Drawing Sheets

TOOL FOR COILING FIRE HOSES AND A METHOD OF USE THEREFOR

BACKGROUND OF THE INVENTION

1. Field of the Invention

This invention relates to a tool for coiling a fire hose and, more particularly, a tool that is hand held and can be used by a user to coil a fire hose lying on a supporting surface without any direct contact between the user and the fire hose.

2. Description of the Prior Art

There are numerous inventions that have been made to coil fire hoses and the like. Unfortunately, the prior devices suffer from serious disadvantages and the primary method in use today is a manual method only whereby a fire worker or workers manually coil the hoses following use without the assistance of any reels or tools. One prior device is described in U.S. Pat. No. 3,168,260 entitled "Device for Rolling Up Canvas Hose", said patent naming A. L. Kittelson as inventor and being issued on Feb. 2nd, 1965. Generally, this invention is a reel that is mounted onto a fire truck. There are numerous known devices that are designed to be mounted onto fire trucks. However, these types of devices take up space on the fire truck and space is extremely limited. In addition, it is necessary to drag the hoses to the truck, usually when they are filled with water, and to connect the hoses into the winding device. There are also known devices that use a reel or turntable oriented in a horizontal position on the ground (e.g. see U.S. Pat. No. 2,197,767 entitled "Hose Winder or Reel", said patent naming H.G. Neale as inventor and being issued on Apr. 23, 1940. The known devices are either not portable at all or they do not have the degree of portability required to replace the manual method. The hoses must be dragged to these devices. In addition, the prior devices are expensive to manufacture, or they are too heavy, or they take up too much space, or they do not readily permit the coiling of hoses in various positions, or they are not as efficient as rolling the hoses by hand.

SUMMARY OF THE INVENTION

It is an object of the present invention to provide a tool and method for coiling a fire hose lying on a supporting surface where the tool is readily portable and more efficient than rolling the fire hoses by hand. It is a further object of the present invention to provide a tool that is collapsible and therefore uses a minimum of space on a fire truck.

A tool is used for coiling a fire hose lying on a stationary supporting surface where the hose has a coupling at each end thereof. The tool has an elongated member with an upper termination and a lower termination, said lower termination having retention means to releasably retain said hose in an area located between said couplings. The lower termination terminates at a pivot point and the upper termination has turning means to rotate said elongated member about said pivot point when said pivot point contacts said supporting surface. The elongated member has at least two concentrically mounted sections that are sized relative to one another so that the elongated member is longitudinally collapsible. The retention means rotates with said elongated member, thereby causing the hose to slide on the supporting surface and to coil about the lower termination of the elongated member. The tool is portable and is operable without being connected to additional components.

A method of using a tool for coiling a fire hose lying on a stationary supporting surface where the hose has a coupling at each end and the tool has an elongated member with an upper termination and a lower termination, said lower termination having retention means to releasably retain said hose in an area located between said couplings, said lower termination terminating at a pivot point, said upper termination having turning means to rotate said elongated member about said pivot point when said pivot point rests on said supporting surface, said retention means rotating with said elongated member, said method comprising the steps of placing the tool over said hose so that the retention means retains said hose, orienting the tool so that the pivot point rests on the supporting surface, with the elongated member being generally vertical, activating the turning means to rotate said elongated member about said pivot point in an appropriate direction while maintaining said pivot point in contact with said supporting surface while said surface remains stationary, said retention means causing the hose to slide along said surface and to wind about said elongated member in the form of a coil until the entire hose has been wound up, lifting the tool upward to release said retention means from said hose and repeating the steps for another hose lying at another location on the supporting surface.

DESCRIPTION OF A PREFERRED EMBODIMENT

Figure 1:
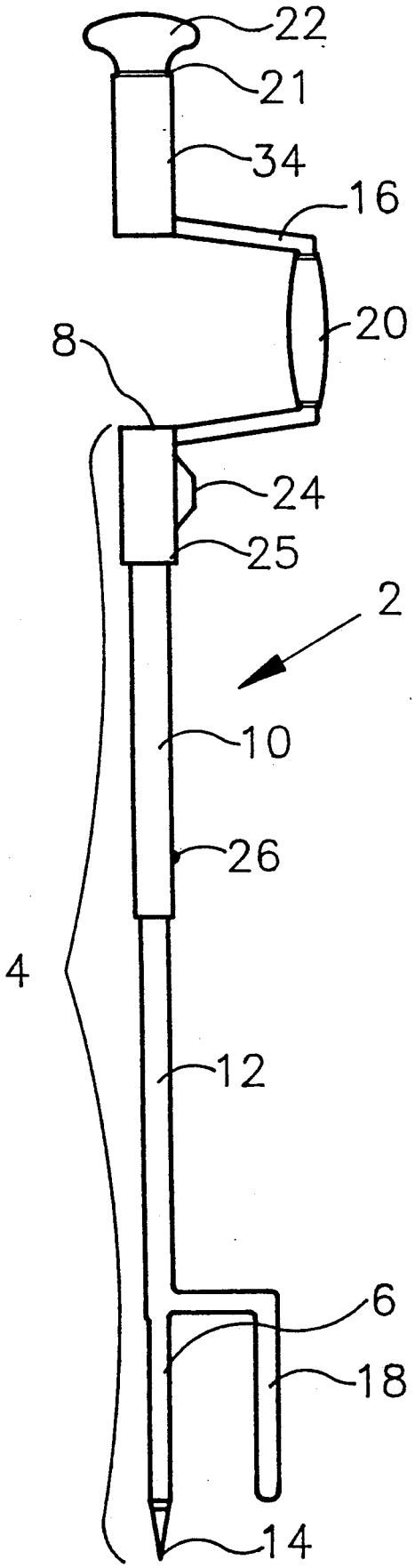
FIG. 1 is a side view of a tool in an extended position.
Figure 2:
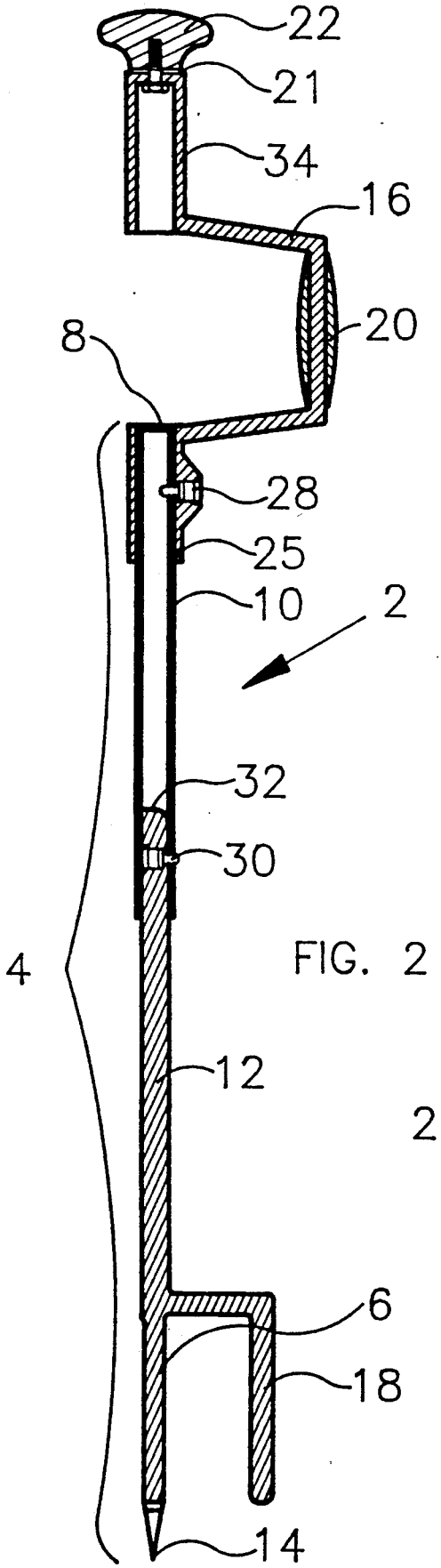
FIG. 2 is a sectional side view of the same tool in the same position.
Figure 3:
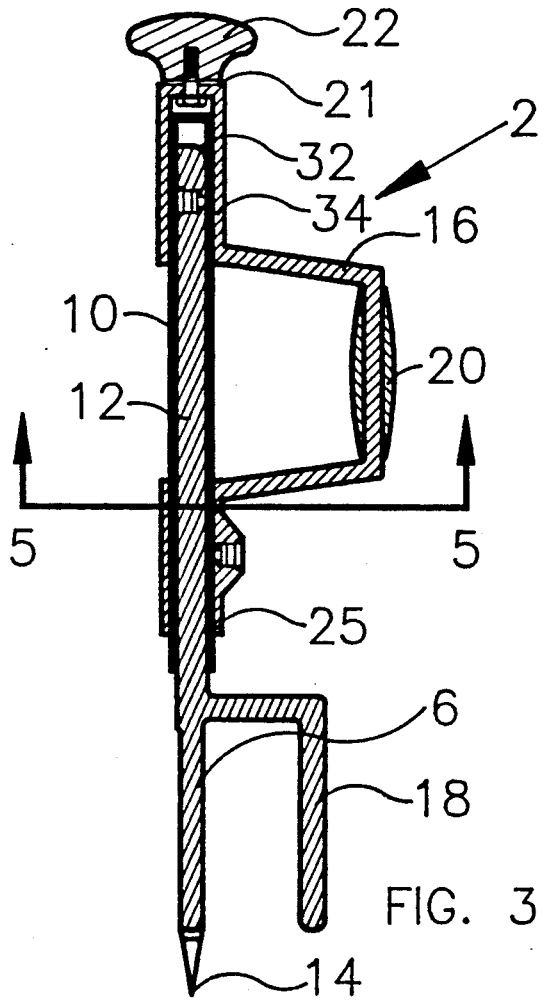
FIG. 3 is a sectional side view of the tool in a collapsed position.

In FIGS. 1, 2 and 3, a tool 2 for coiling a fire hose (not shown) lying on a supporting surface (not shown) has an elongated member 4 with a lower termination 6 and an upper termination 8. The elongated member 4 is divided into two sections, an upper section 10 and a lower section 12. The lower termination 6 terminates at a pivot point 14. Preferably, the pivot point has a replaceable carbide tip. Mounted on the upper termination 8 is a U-shaped handle 16 which provides means for rotating the elongated member 4 about the pivot point 14 when the pivot point rests on the supporting surface. A fire hose has a coupling (not shown) at each end thereof, there being a female coupling at one end of each hose and a male coupling at the other end. At the lower termination 6 of the elongated member 4, there is mounted an L-shaped bracket 18 which provides retention means for releasably retaining the hose in an area located between said couplings. The bracket 18 is open towards the pivot point 14 and rotates with the elongated member 4. The sections 10, 12 are concentrically mounted and are sized relative to one another so that the lower section 12 slidably fits within the upper section 10 so that the member 4 is longitudinally collapsible.

The handle 16 is oriented on the upper termination 8 of the elongated member 4 with a rotatable base 20 of the U-shape extending sideways from the elongated member 4. A rotatable hand grip 22 is mounted at an upper edge 21 of the handle 16. A user can grip the hand grip 22 with one hand and the base 20 with the other hand to manually rotate the base about the elongated member 4 and, in turn, to rotate the elongated member 4 about the pivot point 14.

The upper section 10 has releasable locking means 24 located between said section 10 and a collar 25 of said handle 16. Similarly, the lower section 12 has releasable locking means 26 located between the two sections 10, 12. When the locking means 24, 26 are locked, the tool is in an extended position as shown in FIGS. 1 and 2. When the locking means are released, the lower section 12 can slide upward within the upper section 10 and the two sections together can slide upward within the handle 16 to the collapsed position shown in FIG. 3. From the extended position shown in FIG. 2 to the collapsed position shown in FIG. 3, the overall length of the tool 2 is reduced by more than 45%.

Preferably, the locking means are interrelated so that only one locking means needs to be manually released to collapse the tool. The locking means 24, 26 are spring-mounted pins 28, 30 respectively with the first pin 30 being located between the lower section 12 and the upper section 10. The first pin 30 is mounted so that it is released by depressing the pin inward. The second pin 28 is located between the upper section 10 and the collar 25 and is mounted so that it is released by forcing the pin outward. The second pin 28 and an upper end 32 of the lower section 12 are tapered relative to one another so that when the pin 30 is released and the lower section 12 is forced upward into the upper section 10, the upper end 32 contacts and slides over the pin 28 forcing it outward and automatically releasing said pin 28 so that the sections 10, 12 can together slide through the collar 25 of the handle 16 with the upper termination 8 and the upper end 32 resting within a sleeve 34 of the handle 16 adjacent to the upper edge 21. Thus, by depressing the first pin 30 and sliding the lower section 12 into the upper section 10, the pin 28 is automatically released. The tool can therefore be moved from the extended position to the collapsed position by manually releasing only one pin 30. The tool can be moved from the collapsed position to the extended position simply by pulling the lower termination away from the handle until the pins 28, 30 are engaged. While the tool is held in the collapsed position by friction between the sections 10, 12 and the sleeve 25, a suitable opening could be made in the sleeve 34 to receive the pin 30 when the tool is collapsed.

Figure 4:
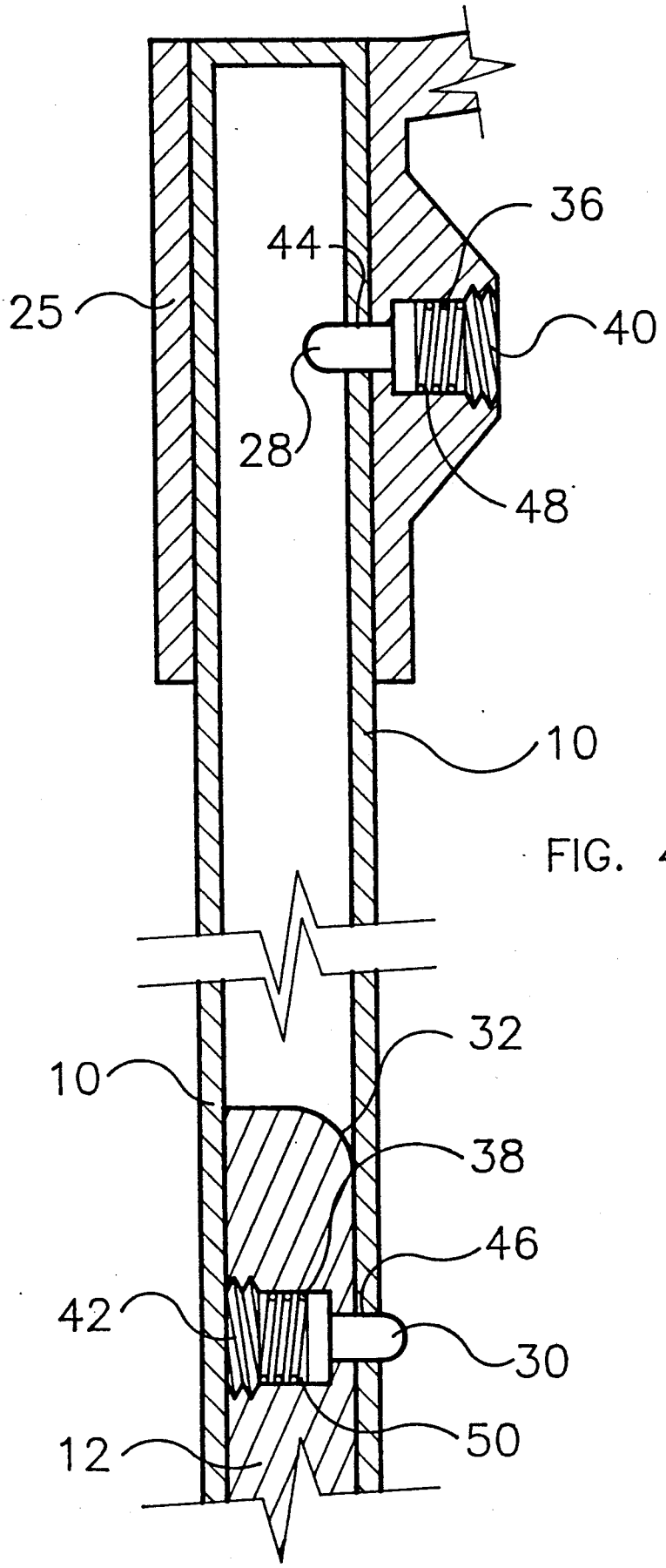
FIG. 4 is an enlarged sectional view of two releasable locking means for said tool.

As can be seen from FIG. 4, the pins 28, 30 have springs 36, 38, respectively. Springs 36, 38 are held in place by countersunk set screws 40, 42 respectively.

Figure 5:
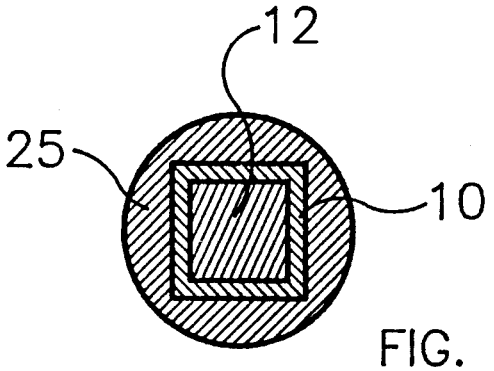
FIG. 5 is a cross-sectional view of a collar and elongated member only along the lines 5—5 of FIG. 3.

As shown in FIG. 5, preferably, the sections 10, 12 as well as the portions of the handle 16 into which the section 10 slides all have a square crosssection. In other words, the collar 25 and sleeve 34 have a square interior cross-section and preferably a circular exterior cross-section. While these components could be designed with a circular cross-section, the square cross-section is preferred to relieve pressure on the pins 28, 30 as the tool is rotated. If the crosssection was circular, the two sections could be designed with corresponding longitudinal grooves to relieve pressure on the pins as the tool is rotated. Suitably located openings 44, 46 receive the pins 28, 30 respectively. The locking means 24 is mounted in an opening 48 in the collar 25 while the locking means 26 is mounted in an opening 50 in the lower section 12. Sections 10, 12 have appropriately located openings (not shown) to accommodate the pins 28, 30. While numerous materials will be suitable to make the tool, it will preferably be made from a material that will resist or eliminate rusting for example, stainless steel or aluminum. Stainless steel is the preferred material.

The tool of the present invention has several advantages, some of which are that it is relatively inexpensive to manufacture; it occupies only a small amount of space in a collapsed position; it is lightweight and readily portable; it allows a user to coil several hoses in succession without having to directly contact any of the hoses; and the hoses can be coiled where they lie and do not have to be dragged to a central location. It also permits any of the hoses to be wound into a straight roll or a doughnut roll, as desired by the user. In a straight roll, the retention means is located immediately adjacent to the male coupling on the hose. For the doughnut roll, the retention means is located at the approximate centre point of the hose. The retention means is open towards the pivot point so that it can be inserted easily over top of the hose and released simply by raising the tool relative to the hose. While the handle is preferably designed for manually turning the tool, power means could be utilized, preferably an electric motor powered by a rechargeable battery.

In a typical use of the device, the tool in a collapsed position is removed from storage and a section is pulled outward relative to the handle 16 to move the tool to the extended position. The tool is then moved downward over a fire hose so that the retention means engages a suitable portion of the hose and the pivot point contacts the supporting surface. The handle 16 is then manipulated to rotate the elongated member about the pivot point with the pivot point remaining in contact with the supporting surface. When the hose has been wound around the lower termination of the elongated member in the form of a coil, the tool can be raised up to release the hose from the retention means. While the hose is being coiled, water within the hose will automatically be drained. The method can then be repeated for subsequent hoses while remaining in the extended position. When it is desired to stop using the tool, the tool can be moved from the extended position to the collapsed position by depressing only the pin 30 and pushing the section 12 into the section 10 and pushing the two sections together into the handle 16 as far as they will go.

What I claim as my invention is:

1. A tool for coiling a fire hose lying on a stationary supporting surface, said hose having a coupling at each end thereof, said tool comprising an elongated member with an upper termination and a lower termination, said lower termination having retention means to releasably retain said hose in an area located between said couplings, said lower termination terminating at a pivot point, said upper termination having turning means to rotate said elongated member about said pivot point when said pivot point contacts said supporting surface, said elongated member having at least two concentrically mounted sections that are sized relative to one another so that the elongated member is longitudinally collapsible, said retention means rotating with said elongated member thereby causing the hose to slide on the supporting surface and to coil about the lower termination of the elongated member, said tool being portable and being operable without being connected to additional components.

2. A tool as claimed in claim 1 wherein the turning means is a U-shaped handle oriented on an upper termination of said elongated member with a base of the U-shape extending sideways from said elongated member, said elongated member being rotated by rotating said base about said elongated member.

3. A tool as claimed in claim 2 wherein the elongated member has two sections, a lower section and an upper section, with releasable locking means for each section, when said locking means are locked, said tool being in an extended position and when said locking means are released, said lower section sliding upward within said upper section and said sections together sliding upward within said handle to a collapsed position, an overall length of said tool from said extended position to said collapsed position being reduced by more than 45%.

4. A tool as claimed in claim 3 wherein the elongated member has two sections, a lower section and an upper section, with releaseable locking means for each section, said lower section sliding upward within said upper section and said sections together sliding upward within said handle to a collapsed position, an overall length of said tool from said extended position to said collapsed position being reduced by more than 45%.

5. A tool as claimed in claim 4 wherein the tool is held in said collapsed position by friction of the upper section within said handle and of the lower section within said upper section.

6. A tool as claimed in any one of claims 1 or 4 wherein the retention means is an L-shaped bracket affixed to said elongated member, said bracket being open towards said point and sized to fit over said hose but not over said coupling.

7. A tool as claimed in any one of claims 3, 4 or 5 wherein there is located a rotatable hand grip at an upper edge of said handle so that one hand of a user can be placed on said hand grip while the other hand of said user can be placed on said base of the U-shape in order to rotate said base about said elongated member.

8. A tool as claimed in claim 3 wherein the locking means are interrelated so that when the locking means between the lower section and upper section are released and the lower section is pushed into the upper section, the locking means between the upper section and the handle is automatically released.

9. A tool as claimed in claim 8 wherein the locking means are spring-mounted pins, a first pin between the lower section and the upper section being mounted s that said first pin is released by forcing said first pin inward, with a second pin between said upper section and said handle being released by forcing said pin outward, said second pin and an upper end of said lower section being tapered relative to one another so that when said lower section is forced upward into said upper section, the upper end of said lower section slides over the second pin and automatically releases it so that the two sections can together slide into said handle.

10. A method of using a tool for coiling a fire hose lying on a stationary supporting surface, said hose having a coupling at each end, said tool having an elongated member with an upper termination and a lower termination, said lower termination having retention means to releasably retain said hose in an area located between said couplings, said lower termination terminating at a pivot point, said upper termination having turning means to rotate said elongated member about said pivot point when said pivot point rests on said supporting surface, said retention means rotating with said elongated member, said method comprising the steps of placing the tool over said hose so that the retention means retains said hose, orienting the tool so that the pivot point contacts the supporting surface, with the elongated member being generally vertical, activating the turing means to rotate said elongated member about said pivot point in an appropriate direction while maintaining said pivot point in contact with said supporting surface while said surface remains stationary, said retention means causing the hose to slide along said surface and to wind about said elongated member in the form of a coil until the entire hose has been wound up, lifting the tool upward to release said retention means from said hose and repeating the steps for another hose lying at another location on the supporting surface.

11. A method of using a tool for coiling a fire hose lying on a supporting surface, said hose having a coupling at each end, said tool having an elongated member with an upper termination and a lower termination said elongated member having two sections, an upper section and a lower section, said lower termination having retention means to releasably retain said hose in an area located between said coupling, said lower termination terminating at a pivot point, said upper termination having a U-shaped handle oriented thereon with a base of said U-shape extending sideways from said elongated member, with a rotating hand grip located at an upper edge of said handle, said elongated member being rotated by rotating said base about said elongated member, said tool having releasable locking means that are spring-mounted pins for each section, a first of said pins being located between the lower section and the upper section and being mounted so that the first pin is released by forcing said pin inward, a second of said pins being located between said upper section and said handle and being released by forcing said pin outward, the second pin and an upper end of said lower section being tapered relative to one another so that when said lower section is forced upward within said upper section, the upper end of the lower section slides over said pin and automatically releases it, said retention means being an L-shaped bracket affixed to said elongated member, said bracket being open towards said pivot point and rotating with said elongated member, said method comprising the steps of starting with the tool in a collapsed position, manually pulling said lower section away from said handle until the tool is in an extended position, placing the tool over said hose so that the L-shaped bracket retains said hose, orienting the tool so that the pivot point contacts the supporting surface, with the elongated member generally vertical, placing downward pressure on said tool with one hand of a user being located on said hand grip and another hand of the user being located on the base of said U-shaped handle, rotating the elongated member about said pivot point in an appropriate direction while maintaining said pivot point in contact with said supporting surface, the retention means causing the hose to wind about said elongated member in the form of a coil until the entire hose has been wound up, lifting the tool upward to release said retention means from said hose and repeating the steps except for the step of moving the tool from a collapsed position to an extended position for any other hose or hoses and ultimately, depressing the first pin and forcing the lower section within the upper section, thereby automatically releasing the second pin and forcing the two sections together into said handle until the tool is in a collapsed position.

12. A method as claimed in any of claims 10 or 11 including the step of placing the tool over said hose in an area between said couplings.

* * * * *